US005603468A

United States Patent [19]

Stahlecker et al.

[11] Patent Number: 5,603,468

[45] Date of Patent: Feb. 18, 1997

[54] TUBE COUPLING SYSTEM FOR SPINDLES OF SPINNING OR TWISTING MACHINES

[75] Inventors: Hans Stahlecker, Süssen; Gerd Stahlecker, Eislingen/Fils, both of Germany

[73] Assignee: Novibra GmbH, Suessen, Germany

[21] Appl. No.: 438,552

[22] Filed: May 10, 1995

[30] Foreign Application Priority Data

Aug. 30, 1994 [DE] Germany ..... 44 30 709.8

[51] Int. Cl.[6] ..... B65H 16/02; B65H 18/02

[52] U.S. Cl. ..... 242/571.6; 242/130; 242/571.7; 242/597.6; 242/597.7

[58] Field of Search ..... 242/571.6, 571.7, 242/597.6, 597.7, 130

[56] References Cited

FOREIGN PATENT DOCUMENTS 1090354 11/1967 United Kingdom .

*Primary Examiner*—William Stryjewski
*Attorney, Agent, or Firm*—Evenson McKeown Edwards & Lenahan, PLLC

[57] ABSTRACT

A tube coupling system for spindles of spinning or twisting machines is provided with two through bore holes arranged at right angles to each other, slightly spaced in an axial direction of a spindle upper part. Two retractable, substantially cylindrical, centrifugal bodies are set in each through bore hole, the centrifugal bodies lying diametrically opposite each other on the outer circumference of the spindle upper part. Directly adjacent of a convex-shaped tube coupling surface, the centrifugal bodies have a conical shoulder arranged on a corresponding opposite surface of the spindle upper part to stop the centrifugal body from falling out. The opposite surface is formed during assembly of the tube coupling system by plastic deformation, whereby the diameter of the though bore holes on the outer circumference of the spindle upper part is reduced somewhat. The advancing of the coupling surfaces against the tube is not hindered during spinning.

27 Claims, 5 Drawing Sheets

TUBE COUPLING SYSTEM FOR SPINDLES OF SPINNING OR TWISTING MACHINES

BACKGROUND AND SUMMARY OF THE INVENTION

The invention relates to a tube coupling system for spindles of spinning or twisting machines, where at least one radial bore hole is provided in a spindle upper part, into which bore hole a centrifugal body with a cylindrical area is set, the centrifugal body being prevented from falling out by a shoulder on a corresponding opposite surface of the spindle upper part, and being provided with a coupling surface on its front side.

In the case of a tube coupling system of this kind (British patent 10 90 354), the spindle upper part is provided with a longitudinal bore hole with a relatively large diameter. There are at least three radial bore holes in the wall of the hollow cylindrical spindle upper part, arranged equidistant over the circumference of the spindle upper part. In each bore hole a mainly cylindrical centrifugal body is set, which has a shoulder enlarged in diameter towards the axis of the spindle upper part, so that the centrifugal body cannot fall out during operation. The preferred number of three centrifugal bodies are set into the corresponding radial bore holes from the inside, through the axial bore hole of the spindle upper part during assembly. The axial bore hole is then closed with a cap, the cap projecting deeper into the axial bore hole by means of a cylindrical extension so that the centrifugal bodies can rest against the extension when the spindle is not in operation. When the spindle is in operation, the centrifugal bodies, by means of the centrifugal forces, move so far outwards that the coupling surface on the front side of the centrifugal bodies rests on the inner wall of the attached tube.

Apart from the fact that the putting on of a cap to close the axial bore hole of the spindle upper part brings with it the danger of a state of unbalance, the production and assembly costs for the tube coupling system are relatively high. Besides the three radial bore holes, which must be exactly equidistant from each other on the circumference, an exactly aligned axial bore hole has to be provided. The setting up of the centrifugal bodies from the inside of the spindle upper part requires a certain amount of skill.

An object of the invention is to make a tube coupling system which is easy to produce and assemble and where the danger of unbalance is small.

This object is achieved according to preferred embodiments of the invention in that the shoulder in the area of the coupling surface and the opposite surface in the area of the outer circumference of the spindle upper part is configured so the diameter towards the bore hole radial outer end is smaller.

According to the invention, production therefore is confined to placing the radial bore holes at the given places and setting the mainly cylindrical centrifugal bodies into them. In a mass production, very small permissible variations can be maintained, and the danger a state of unbalance is small. The diameter of the bore hole on the outer circumference of the spindle upper part is reduced slightly during the assembly of the centrifugal bodies, just so much that an opposite surface for the shoulder is formed so that the centrifugal bodies cannot spin off during operation when a tube is not attached. The reduction of the diameter is however small enough to allow the centrifugal bodies with their coupling surface to move far enough out of the radial bore hole to hold a tube.

The opposite surface, on which the shoulder of a centrifugal body rests, is preferably formed by means of plastic deformation of the spindle upper part. This deformation can be effected by caulking or crimping the spindle upper part with the centrifugal body.

With regard to the manufacture for this plastic deformation during assembly, it is practical when the shoulder of the centrifugal body is formed as a conical stopping face. The coupling surface itself is for this purpose convex, so that the centrifugal body with its curvature can overhang the radial bore hole sufficiently and thus create the coupling with the tube.

In a particularly advantageous development of the invention, the bore hole is formed as a through bore hole, in which two retractable centrifugal bodies are set, the centrifugal bodies lying diametrically opposite each other on the outer circumference of the spindle upper part. The providing of a through bore hole at right angles to the axis of the spindle upper part is particularly easy to do, and the danger of a state of unbalance is significantly smaller than if only bottom holes for the centrifugal bodies were to be used. Two centrifugal bodies can be set in a single through bore hole, which then also have exactly the same distance between angles in circumferential direction of the spindle upper part. The danger of a state of unbalance is therefore very small. The length of the centrifugal bodies is such that they do not project out of the spindle upper part when the spindle is not operating. For this purpose the length of the centrifugal bodies is approximately the same as the radius of the spindle upper part so that the centrifugal bodies in the area of the axis of the spindle upper part can be arranged alongside one another. When in operation, the coupling surfaces of the two diametrically opposed centrifugal bodies project sufficiently far out of the through bore holes.

In a further advantageous development of the invention it is provided that two through bore holes, slightly out of line with each other in the axial direction of the spindle upper part, are set at right angles to each other. In this way, four coupling points are created, on which the coupling surfaces of the centrifugal bodies can rest on the inner wall of the tube.

Centrifugal clutches in general have a great advantage in that the coupling effect is increased with increasing spindle revolutions, that is, the effect is particularly great when it is actually most needed. When the spindle is at a standstill, however, no centrifugal forces are at work and therefore no pressure, so that tubes can be placed easily on the relevant spindle upper part without having to overcome coupling forces.

In a process to assemble the tube coupling system of the invention, the following procedure is carried out: first, a peg of a tool, axially supported, is set into the through bore hole, the peg having an appropriate stopping face of the shape and operational position of the shoulder of a centrifugal body. Then a first opposite surface is created through pressure on the stopping face by means of a stamp. The peg is then removed from the bore hole and both centrifugal bodies are set in their place. Finally, the centrifugal body, facing away from the first opposite surface, is brought into its operational position by means of a supporting plug to be placed on the side of the first opposite surface, and, by means of the above-mentioned stamp, the second opposite surface is created through pressure applied to the shoulder of the relevant centrifugal body. Further advantages and features of the invention will become apparent from the following description in conjunction with the accompanying drawings.

Other objects, advantages and novel features of the present invention will become apparent from the following detailed description of the invention when considered in conjunction with the accompanying drawings.

DETAILED DESCRIPTION OF THE DRAWINGS

Figure 1:
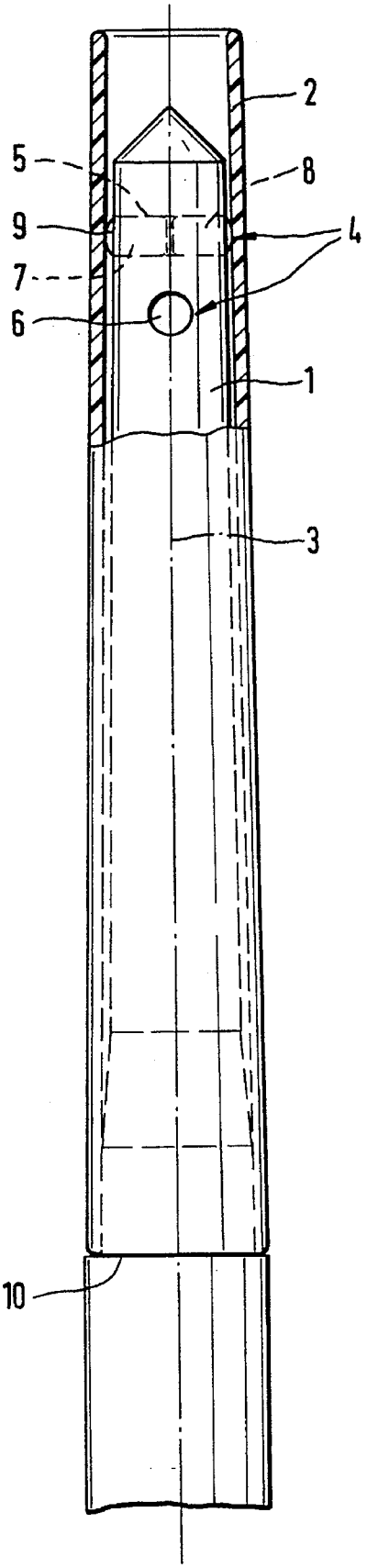
FIG. 1 is a partial sectional longitudinal view of a spindle upper part with a tube coupling system of the invention.

FIG. 1 shows only the upper part of a spindle of a spinning or twisting machine, the so-called spindle upper part 1, with a tube 2 attached. The axis of rotation is marked with a 3.

A tube coupling system 4, in this case formed as a four-point centrifugal clutch, is provided for coupling the tube 2 onto the spindle upper part 1 when the spindle is driven to rotate while in operation. For this tube coupling system 4, two radial bore holes 5 and 6, constructed as through bore holes and set slightly out of line to each other in the axial direction of the spindle upper part 1, are placed at right angles to each other. In each of these bore holes 5 and 6, two retractable centrifugal bodies 7 and 8 are set, which bodies lie diametrically opposite each other on the outer circumference of the spindle upper part 1. The length of a centrifugal body 7 or 8 is approximately the same as the radius of the spindle upper part 1. Both the substantially cylindrically formed centrifugal bodies 7 and 8 are provided on their end face which projects out of the radial bore holes 5 and 6 with a convexly curved coupling surface 9.

Due to the two radial bore holes 5 an 6, together with the four centrifugal bodies 7 and 8, four coupling points are formed between the spindle upper part 1 and the tube 2. The tube 2 supports itself in the axial direction against a collar 10 of the spindle upper part 1.

Figure 2:
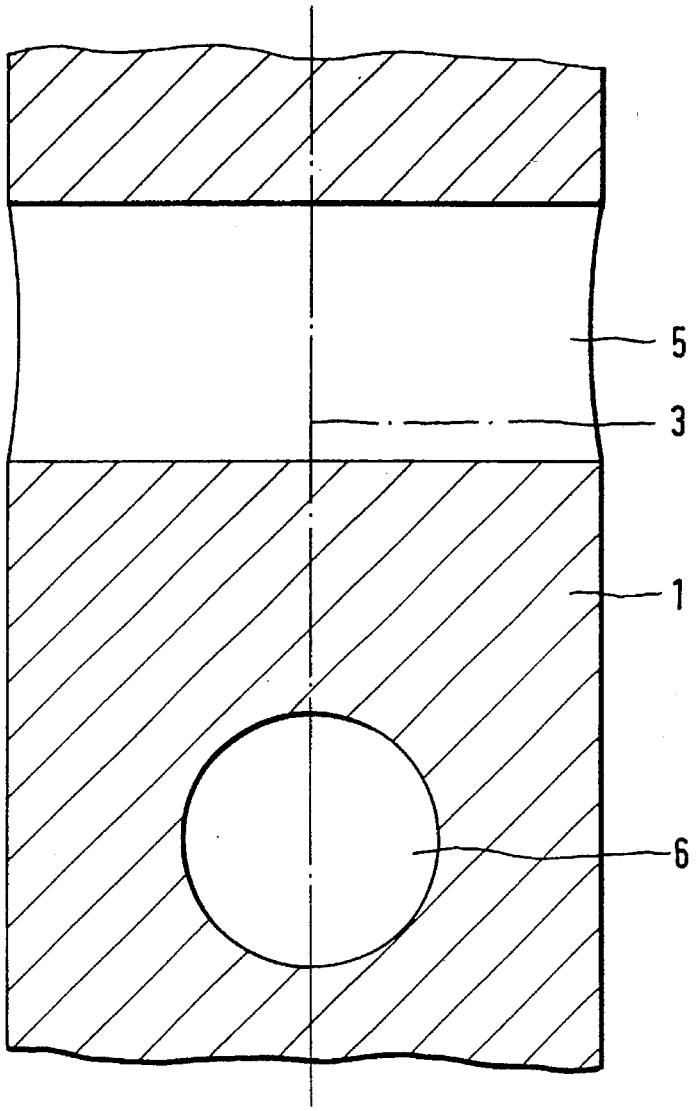
FIG. 2 shows a greatly enlarged representation of the area of the through bore holes for the centrifugal bodies of the tube coupling system.

FIG. 2 shows, greatly enlarged and in sectional view, the area where the two radial bore holes 5 and 6 of the spindle upper part 1 cross each other before the relevant centrifugal bodies 7 and 8 are introduced. It can be seen that each bore hole 5,6, formed as a through bore hole, is completely cylindrical.

Figure 3:
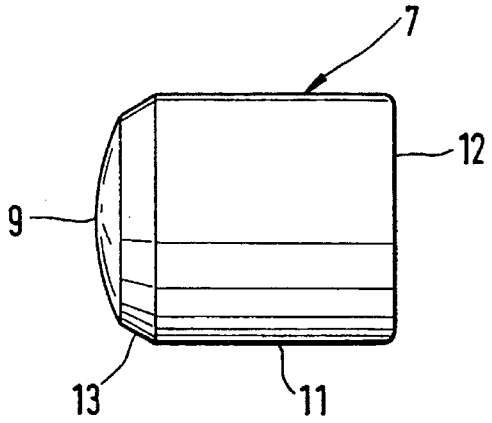
FIG. 3 shows an equally enlarged representation of a centrifugal body according to the invention.

FIG. 3 shows, also greatly enlarged, one of the four centrifugal bodies 7, all four being formed in the same way. It has mainly a longer cylindrical area 11 as well as a flat surface on the radially inward side 12 facing the rotation axis 3 of the spindle. The other radially outward side, which projects from the relevant bore hole 5 or 6 during operation, is convexly formed and serves as a coupling surface 9.

The cylindrical area 11 of the centrifugal body 7 (as well as of the other three centrifugal bodies, constructed in the same way) graduates into the coupling surface 9 with a short conically shaped shoulder 13. The shoulder 13 is in the immediate vicinity of the curved coupling surface 9. The shoulder 13 serves, in a way to be described later, to prevent the centrifugal body 7 from being thrown off the spindle upper part 1 during operation, that is, when it rotates around the rotation axis 3, in case, for whatever reason, a tube 2 is not applied to the spindle upper part 1.

Figure 4:
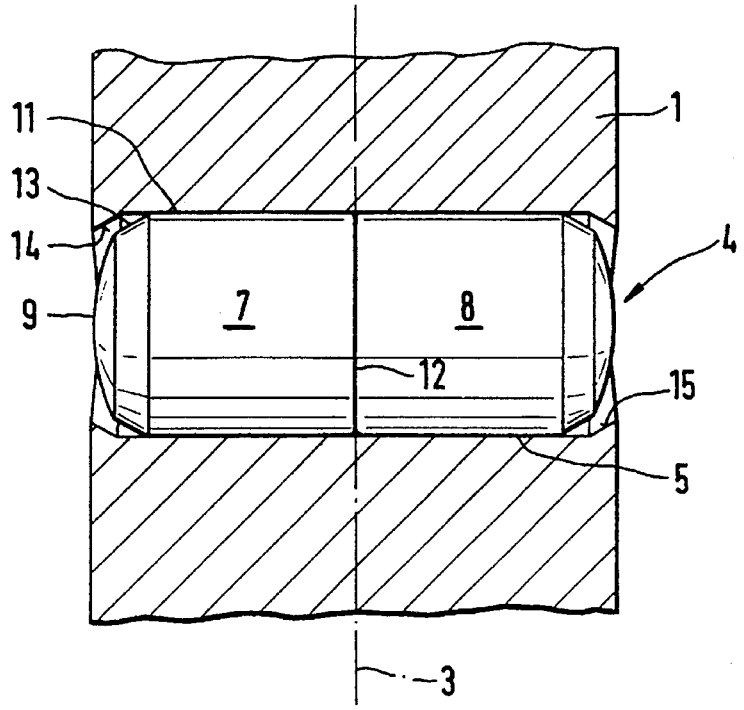
FIG. 4 shows a greatly enlarged representation of the spindle upper part in the area of a through bore hole into which two centrifugal bodies, lying on each other, are set, the spindle upper part being at a standstill.

FIG. 4 shows two centrifugal bodies 7 and 8, whose coupling surfaces 9 lie diametrically opposite to each other on the outer circumference of the spindle upper part 1, and which have been arranged in the radial bore hole 5. This applies to bore hole 6, also constructed as a through bore hole, but which is not shown in FIG. 4.

It can be seen that the cylindrical area 11 of the two centrifugal bodies 7 and 8 is made to fit the bore hole 5 in such a way that, as a result of the centrifugal forces during operation, the centrifugal bodies 7 and 8 can, by sliding in the bore hole 5, move to the outer circumference of the spindle upper part 1. The two end surfaces 12 on the radially inward side of the centrifugal bodies 7 and 8 can rest together when the spindle is at a standstill, that is when the centrifugal bodies 7 and 8 are completely retracted in the bore hole 5. The coupling surfaces 9 do not stand projecting outwards from the bore hole 5 when the end surfaces 12 on the radially inward side of the centrifugal bodies 7 and 8 touch each other. The centrifugal bodies 7 and 8 do not of course move towards the rotation axis 3 when the spindle is coming to a standstill, but due to the curving of the coupling surface 9, they each shift slightly towards the rotation axis 3 when a tube 2 is removed or when a new tube 2 is applied.

As can be seen clearly from FIG. 4, a corresponding opposite surface 14 is arranged at each shoulder 13 on the outer circumference of the spindle upper part 1. These opposite surfaces 14 and 15 are formed where the bore hole 5 (this applies also to the bore hole 6) graduates into the outer circumference of the spindle upper part 1 and they are formed during assembly of the centrifugal bodies 7 and 8 by plastic deformation of the spindle upper part 1 at that place. The plastic deformation takes place preferably by means of caulking, which will be described later.

As can be seen from FIG. 4, the opposite surfaces 14 and 15 reduce the diameter of the bore hole 5 slightly (and also of bore hole 6), after assembly of the centrifugal bodies 7 and 8, at the point where it graduates into the outer circumference of the spindle upper part 1, but only so much that the shoulders 13 of the centrifugal bodies 7 and 8 can, when necessary, rest against the relevant opposite surfaces 14 and 15, should a tube 2 not be applied to the spindle upper part 1. However, during normal operation, when the spindle upper part 1 is rotating, there is a short distance between the shoulders 13 and the relevant opposite surfaces 14 and 15.

Figure 5:
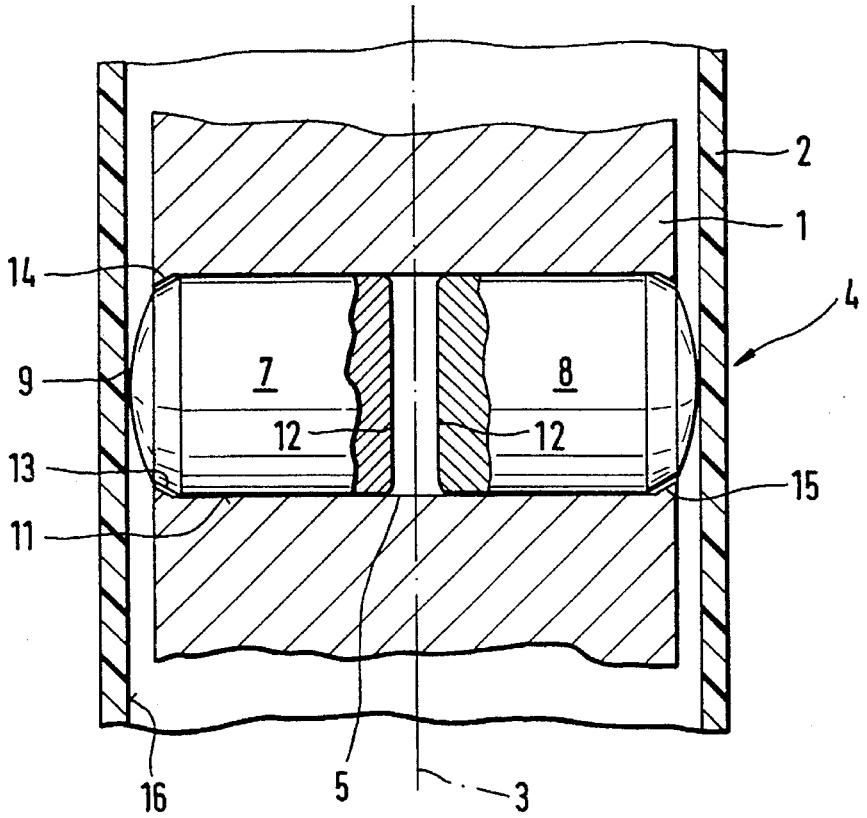
FIG. 5 shows a representation of FIG. 4 in operation, whereby a tube is additionally attached.

The tube coupling system 4 is shown in operation in FIG. 5, that is, with a tube 2 applied and a rotating spindle upper part 1. It can be seen that the centrifugal bodies 7 and 8 have, as a result of the centrifugal forces, moved towards the wall 16 of the tube 2, so that the centrifugal bodies 7 and 8 couple with frictional connection with their coupling surfaces 9 to the tube 2 on the spindle upper part 1.

There is now only a short distance between the shoulders 13 of the centrifugal bodies 7 and 8 and the opposite surfaces 14 and 15. As can be seen, the opposite surfaces 14 and 15 enable the coupling surfaces 9 to advance to the wall 16. One can see furthermore that there is a certain distance between the front surfaces 12 of the centrifugal bodies 7 and 8 during operation.

Figure 6:
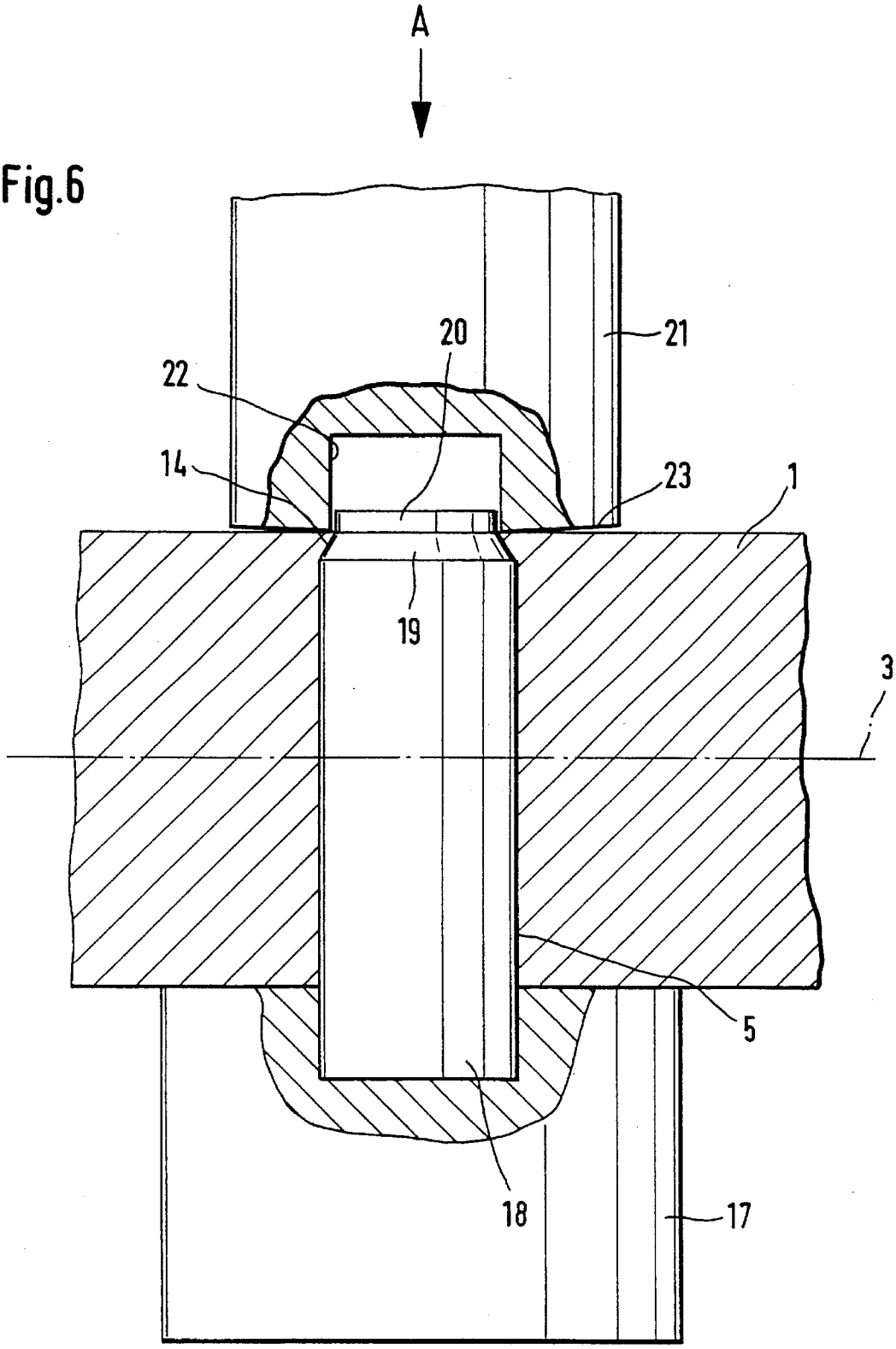
FIG. 6 shows a greatly enlarged representation of the tools for making a first opposite surface by plastic deformation of the spindle upper part.
Figure 7:
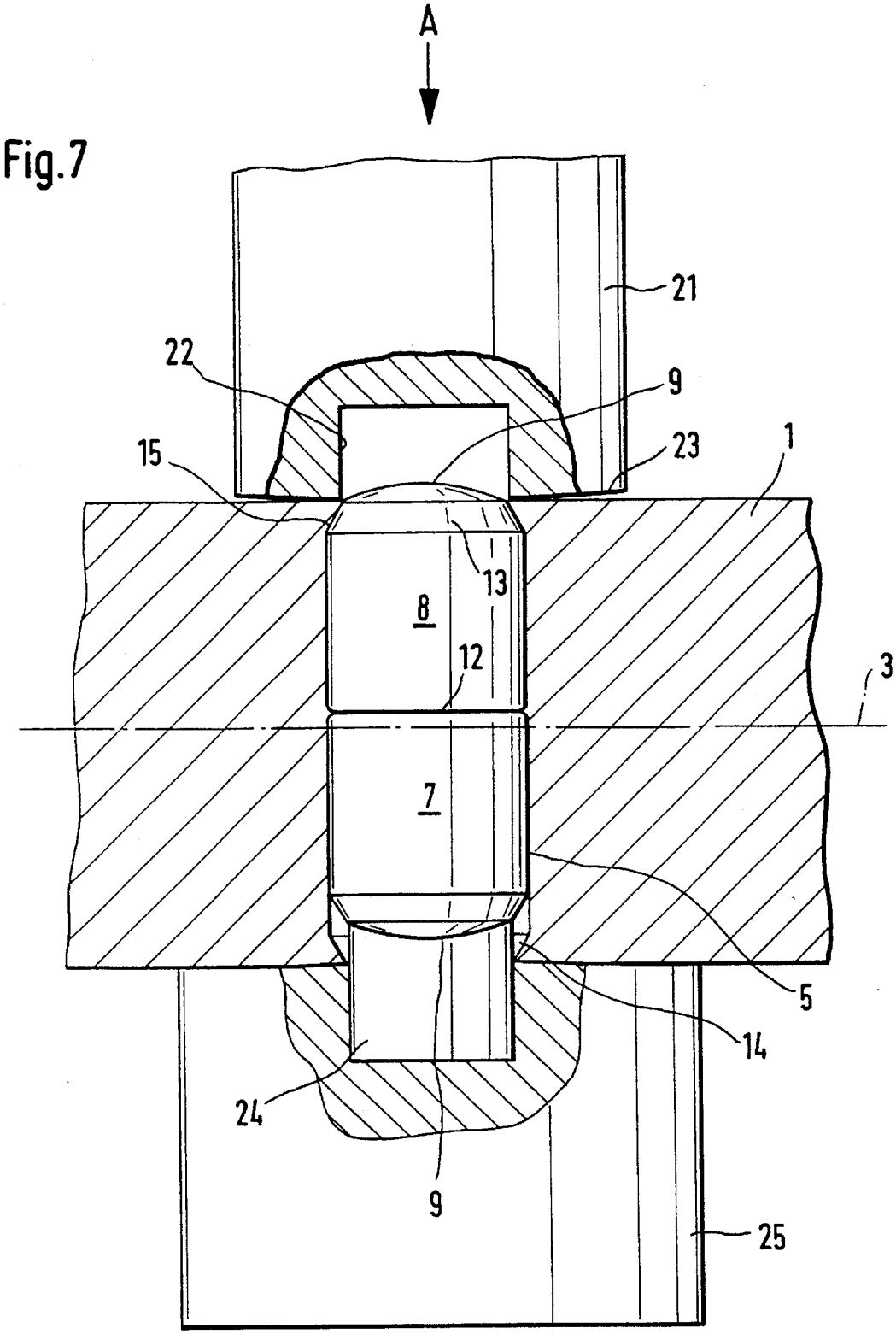
FIG. 7 shows the tools for making the second opposite surface of the through bore hole.

With the aid of the greatly enlarged representations in FIGS. 6 and 7, the manufacture of the above mentioned opposite surfaces 14 and 15, arranged at the shoulders 13, by plastic deformation of the spindle upper part 1, is illustrated. The rotation axis 3 of the spindle upper part 1 is now shown horizontally in the diagram, differing from previous diagrams.

The tool comprises an anvil 17 into which a peg 18, axially supported, is firmly fixed, the outer circumference of said peg 18 measuring exactly the same as the outer circumference of the centrifugal bodies 7 and 8. The peg 18 is first placed into the bore hole 5, formed as a through bore hole, or the spindle upper part 1 is fixed onto the peg 18. The peg 18 has a stopping face 19, whose shape is exactly the same as that of the conical shoulder 13 of the centrifugal bodies 7 and 8; it also has a centering collar 20 beside the shoulder 13. The length of the peg 18 is such that the stopping face 19 takes up exactly the same position that a centrifugal body 7 would if its shoulder 13 rested on the relevant opposite surface 14. This opposite surface 14, already shown in FIG. 6, does not yet exist, that is, the diameter of the bore hole 5 remains, for the moment, continuously constant (as opposed to FIG. 6).

The anvil 17 is arranged coaxially to a stamp 21, the stamp being movable in the direction of arrow A. The stamp 21 comprises a stem hole 22, which can slip onto the centering collar 20. The working surface 23 of the stamp 21 is not quite flat, but rather deviates slightly conically from the flat surface. When the stamp 21 is advanced in arrow direction A with a certain amount of force to the spindle upper part 1 and the peg 18, the first opposite surface 14 is created through plastic deformation by pressure on the stopping face 19. The diameter of the bore hole 5 is thereby reduced slightly on the outer circumference of the spindle upper part 1, as shown in FIG. 6. The stamp 21 is then drawn back against the direction of arrow A, and the peg 18 is drawn downwards again, or the spindle upper part 1 is drawn upwards. The spindle upper part 1 is now turned 180° around the rotation axis 3, as shown in FIG. 7, so that the finished opposite surface 14 comes to rest underneath (the second opposite surface 15 does not yet exist, contrary to representation in FIG. 7). Two centrifugal bodies 7 and 8 are now set into the bore hole 5 from above, with each radially inward side surface 12 resting on one another, whereby the coupling surface 9 of the lower centrifugal body 7 is supported on an appropriately formed stopping face of a supporting plug 24. The supporting plug 24 is placed in another anvil 25 for this purpose.

The length of the supporting plug 24 is such that the shoulder 13 of the upper centrifugal body 8 now takes up exactly the position that the stopping face 19 took up in the stamping process described above. The already assembled centrifugal body 8 becomes, temporarily, a tool.

The stamping process, effected by the stamp 21, now takes place as described above for the manufacture of the first opposite surface 14, that is the working surface 23 is advanced to the outer surface of the spindle upper part 1 whereby the stem hole 22 moves with clearance over the relevant coupling surface 9 of the centrifugal body 8 when the stamp 21 is activated in arrow direction A. The second opposite surface 15 is thus formed by plastic deformation (caulking), so that it is then impossible, after removal of the tool, to remove the centrifugal bodies 7 and 8 from the bore hole 5. They are merely able to move only so far away from each other as is shown in FIG. 5.

The opposite surfaces for the other bore hole 6 are made in the same way as described for bore hole 6.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A tube coupling system for coupling a tube to a spindle of a textile spinning or twisting machine, comprising:

a radially extending bore hole in an upper spindle part, a centrifugal body slidably disposed in the bore hole, said centrifugal body having a radially outward facing coupling surface for clampingly engaging with an inside surface of a tube placed over the spindle in response to rotation of the spindle, and a reduced cross section radial outer end of the bore hole adjacent a circumferential surface of the spindle providing an abutment surface for preventing the centrifugal body from falling out during rotation of the spindle without a tube, wherein the centrifugal bodies limit the inward radial motion of one another.

2. A tube coupling system according to claim 1, wherein the bore hole is a through hole and where the centrifugal body is a cylindrical body.

3. A tube coupling system according to claim 2, wherein the abutment surface is formed by plastic deformation of spindle material forming the radial outer end of the bore hole.

4. A tube coupling system according to claim 3, wherein the plastic deformation of the spindle material is effected by caulking with the centrifugal body.

5. A tube coupling system according to claim 4, wherein the abutment surface is formed as a conical stopping face.

6. A tube coupling system according to claim 4, wherein the bore hole is formed as a through bore hole, into which two retractable centrifugal bodies are set which lie diametrically opposed to each other on an outer circumference of the spindle upper part.

7. A tube coupling system according to claim 6, wherein the combined length of the two centrifugal bodies is approximately that of the diameter of the spindle upper part at the location of the respective associated bore hole.

8. A tube coupling system according to claim 1, wherein the abutment surface is formed by plastic deformation of spindle material forming the radial outer end of the bore hole.

9. A tube coupling system according to claim 8, wherein the plastic deformation of the spindle material is effected by caulking with the centrifugal body.

10. A tube coupling system according to claim 9, wherein the abutment surface is formed as a conical stopping face.

11. A tube coupling system according to claim 1, wherein the abutment surface is formed as a conical stopping face.

12. A tube coupling system according to claim 1, wherein the coupling surface is convexly formed.

13. A tube coupling system according to claim 1, wherein the bore hole is formed as a through bore hole, into which two retractable centrifugal bodies are set which lie diametrically opposed to each other on an outer circumference of the spindle upper part.

14. A tube coupling system according to claim 13, wherein the combined length of the two centrifugal bodies is approximately that of the diameter of the spindle upper part at the location of the respective associated bore hole.

15. A tube coupling system according to claim 11, wherein two bore holes, formed as through bore holes and slightly out of line to each other in axial direction of the spindle upper part, are arranged at right angles to one another, each of said bore holes being provided with respective pairs of said centrifugal bodies.

16. A process for making a tube coupling system for coupling a tube to a spindle at a textile spinning or twisting machine, comprising:

forming a radial through bore hole in an upper part of a spindle, providing first and second centrifugal bodies which are configured to slidably move in the bore hole, each of said centrifugal bodies having a radially outward facing coupling surface which is configured to clampingly engage an inside surface of a tube placed over the spindle in response to rotation of the spindle, setting an axially supporting peg of a tool in the bore hole, said peg having a similar form and operating position as the coupling surface of one of the centrifugal bodies, deforming said spindle adjacent a radially outer first end of the bore hole by means of a stamp forced against the spindle from radially outside the spindle against the peg, removing the peg from the bore hole and placing the two centrifugal bodies into a radially outer second opposite end of the bore hole, moving the centrifugal body at said second end of the bore hole to its predetermined clamping position by means of a plug pushing against the other centrifugal body, and deforming said spindle adjacent the radially outward second end of the bore hole by means of a stamp forced against the spindle from radially outside the spindle against the centrifugal body positioned by said plug.

17. A process according to claim 16, wherein a second similar bore hole and centrifugal body pair are provided at a location axially spaced from the first bore hole.

18. A process according to claim 17, wherein said bore holes are disposed at right angles with respect to one another.

19. A process according to claim 17, wherein said bore hole is a cylindrical bore hole and said centrifugal bodies have a corresponding cylindrical cross section.

20. A tube coupling system for coupling a tube to a spindle of a textile spinning or twisting machine, comprising:

a radially extending through bore hole in a spindle, two centrifugal bodies slidably disposed in the through bore hole diametrically opposed to each other, each centrifugal body having a radially outwardly facing coupling surface clampingly engageable with an inside surface of a tube placed over the spindle in response to rotation of the spindle, and reduced cross sectional sections of the through bore hole in the areas of the coupling surfaces which provide abutment surfaces preventing the centrifugal bodies from falling out the spindle, wherein the centrifugal bodies limit the inward radial motion of one another.

21. A tube coupling system according to claim 20, wherein said centrifugal bodies are directly abuttingly engageable with one another.

22. A tube coupling system according to claim 20, wherein the radially extending bore hole is disposed in an upper spindle part of the spindle.

23. A tube coupling system according to claim 20, wherein the centrifugal bodies are cylindrical bodies.

24. A tube coupling system according to claim 20, wherein the bore hole is a cylindrical bore hole intermediate the reduced cross sectional sections.

25. A tube coupling system according to claim 23, wherein the bore hole is a cylindrical bore hole intermediate the reduced cross sectional sections.

26. A tube coupling system according to claim 20, wherein the outer radial ends of the centrifugal bodies include an annular centering shoulder.

27. A tube coupling system according to claim 25, wherein the outer radial ends of the centrifugal bodies include an annular centering shoulder.

* * * * *